US005478089A

United States Patent [19]

Austin

[11] Patent Number: 5,478,089

[45] Date of Patent: Dec. 26, 1995

[54] MODIFIED WEDGE ARROWHEAD

[76] Inventor: Terry Austin, Rte. 1, Box 260, Thornton, W. Va. 26440

[21] Appl. No.: 426,666

[22] Filed: Apr. 21, 1995

[51] Int. Cl.[6] ..... F42B 6/08

[52] U.S. Cl. ..... 273/419

[58] Field of Search ..... 273/416, 419–422; D22/115

[56] References Cited

U.S. PATENT DOCUMENTS

| | | | |
|---|---|---|---|
| D. 310,553 | 9/1990 | Kania et al. | D22/115 |
| 4,146,226 | 3/1979 | Sorensen | 273/422 |
| 4,166,619 | 9/1979 | Bergmann et al. | 273/421 X |
| 4,210,330 | 7/1980 | Kosbab | 273/422 |
| 4,254,958 | 3/1981 | Bateman, III | 273/421 |
| 4,565,377 | 1/1986 | Troncose, Jr. et al. | 273/422 |
| 5,143,380 | 9/1992 | Maleski | 273/422 |
| 5,257,809 | 11/1992 | Carrizosa | 273/422 |
| 5,269,534 | 12/1993 | Saunders et al. | 273/419 |

*Primary Examiner*—Paul E. Shapiro
*Attorney, Agent, or Firm*—Whitham, Curtis, Whitham & McGinn

[57] ABSTRACT

An arrowhead includes a conical forward region (16), a pair of chisel regions (18) on opposing sides of the arrowhead (10), and a pair of wedge regions (20) on opposing sides of the arrowhead (10), wherein the wedge regions (20) are positioned adjacent and between the chisel regions (18) around the circumference of the arrowhead (10). The conical forward region (16) assists in stabilizing the flight of the arrow and in directing the arrowhead (10) into a target animal. The chisel regions (18) and wedge regions (20) enhance the arrowhead's (10) ability to pass through bone, cartilage, hide, and other difficult to penetrate materials. The chisel regions (18) and wedge regions (20) are distinct from the conical forward region (16) in that the conical forward region (16) is cone shaped around its circumference, while the chisel regions (18) and wedge regions (20) are planar in character. The wedge regions (20) are composed of a first angular region (26) and a second angular region (28), where the first angular region (26) has a smaller total angle than the second angular region (28). Thus, the first angular region (26) and second angular region operate in conjunction to "wedge-open" or separate bone, cartilage, or other dense matter.

10 Claims, 1 Drawing Sheet

MODIFIED WEDGE ARROWHEAD

BACKGROUND OF THE INVENTION

1. Field of the Invention

The invention is generally directed to archery equipment, and is particularly related to the point of an arrowhead which allows for enhanced penetration through bone, cartilage, hide, and other difficult to penetrate materials. The point is specifically designed to separate difficult to penetrate materials such as bone through a wedging action after the point first contacts the material.

2. Description of the Prior Art

Hunting wild game using archery equipment is a centuries old tradition. Recent advances in archery equipment have again popularized the sport. One particular area of invention and innovation that has lead to improved results in terms of flight accuracy, speed at impact, and rate of kill, and the like, is focussed on the arrowhead. Ultimately, an arrow kills an animal through hemorrhage and bleed out. Thus, it is important that the arrow be able to penetrate into, and preferably through, the target animal. A wide variety of designs of arrowheads have been devised, wherein the object is to create maximum damage and hemorrhaging. For example, U.S. Pat. Nos. 4,998,738, 5,082,292, 5,100,143, and 5,112,063 to Puckett show examples of a highly accurate arrowhead with deployable blades which open upon impact with an animal, and U.S. Pat. No. 5,172,916 to Puckett shows an arrowhead with blades that protrude from the body member, but which can move forward upon withdrawal of the arrowhead from an animal.

Prior to this invention, most arrowhead designers have focussed their attention on the arrowhead blades and the choice of materials for use in the arrowhead. This is principally due to the effect wind shear has on the accuracy of the arrowhead, and to the effect weight of the arrowhead has on the speed of the arrow at impact. Few people have made much modification to the point of the arrowhead. Typically, the point of the arrowhead is either conical or chisel-like. U.S. Pat. Nos. 4,998,738, 5,082,292, 5,100,143, 5,112,063, and 5,172,916 to Puckett show examples of conical points, and U.S. Pat. No. 5,143,380 to Maleski and U.S. Pat. No. 5,160,148 to Musacchia show examples of chisel-like points. Maleski shows a multifacetted chisel-like point.

It would be advantageous to provide a point-design which can be used on a wide variety of arrowheads that improves the penetration of the arrow through bone, cartilage, hide, and other materials. Because the point is the first portion of the arrowhead to contact a game animal, improvements in its design can have a profound enhancement on the overall performance of the arrowhead.

SUMMARY OF THE INVENTION

It is an object of this invention to provide an arrowhead point which allows for improved penetration through bone, hide, cartilage, and other difficult to penetrate materials.

According to the invention, the point of an arrowhead includes a conical forward region followed by two chisel and two wedge regions. The two chisel and the two wedge regions are positioned about the circumference of the point with the two chisel regions being located on opposite sides from each other, and the two wedge regions being located on opposite sides from each other. Although not required, it is preferred that the sides of the wedge regions contact the sides of the chisel regions. The wedge regions each include two angular regions wherein a first angular region is nearly parallel with a longitudinal axis running from the base of the point to the tip of the point, and a second angular region provides a wide angle extending from the first angular region to the base of the point. The point may be integral with a broadhead body which includes fixed or deployable blades, or may be mountable onto desired arrow shaft or broadhead body using screw-in, glue-in, or other connector arrangements.

In operation, the point penetrates difficult to penetrate material, such as bone, through a "wedge-action" wherein the conical forward region first directs the point into the bone and begins separation. The point then traverses through the opening created by the conical forward region with the first angular regions of the opposing wedge regions allowing the point to easily slide deep into the bone. Once the point is deep into the bone, the second angular regions of the opposing wedge regions acts to smash and separate the bone; thus, allowing the arrowhead, as well as the trailing arrow shaft, to pass cleanly through the bone.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

This invention is primarily directed to the point of an arrowhead. This invention makes improvements in the point design which allow better penetration of the arrow through tough materials such as bone, hide, cartilage, etc. The point design of the present invention can be used on both fixed blade and retractable blade arrowheads. U.S. Pat. No. 4,998,738 to Puckett and U.S. Pat. No. 5,172,916 to Puckett show examples of fixed blade and retractable blade arrowheads, and both references are herein incorporated by reference.

Figure 1:
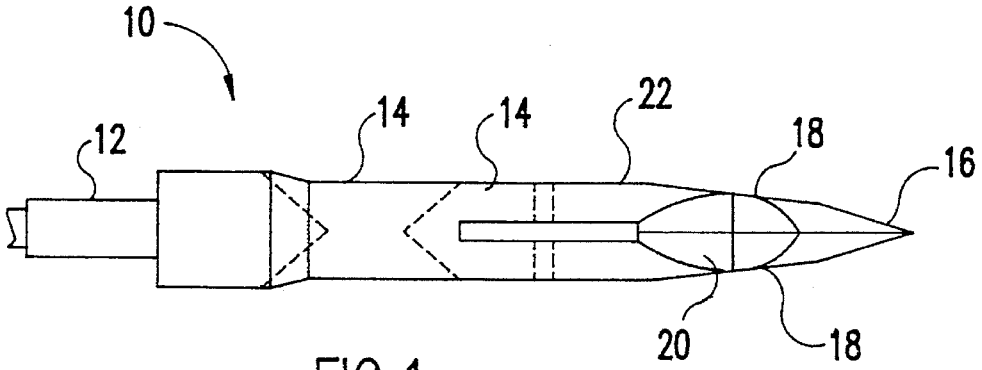
FIG. 1 is a side view of the arrowhead point of this invention showing the surface of a wedge region.

FIG. 1 shows an arrowhead 10 that can be secured to an arrow shaft by connector 12. The connector 12 can be a screw connection, a glue-in connection, or any other suitable means for affixing the arrowhead 10 to an arrow shaft. The arrowhead 10 can have no blades, or deployable, moveable, or fixed blades located at dashed lines 14.

The forward region of the arrowhead 10 includes a point design which enhances penetration of the arrowhead through bone, cartilage, hide, and other difficult to penetrate material.

Figure 2:
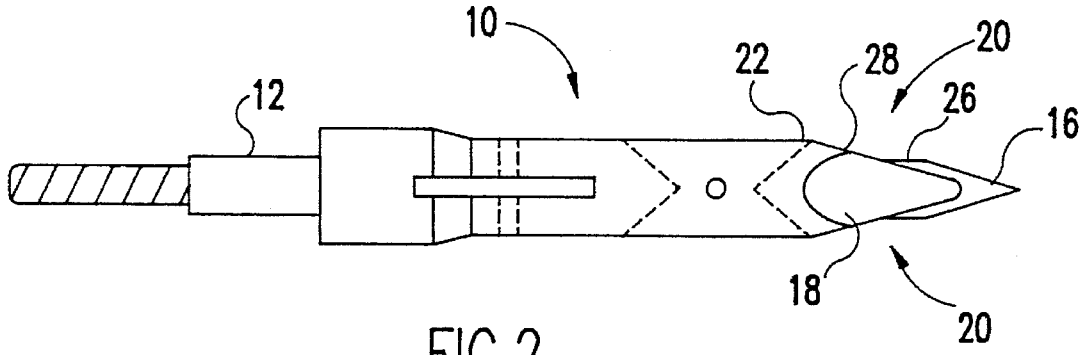
FIG. 2 is another side view of the arrowhead point of FIG. 1 showing the surface of a chisel region.
Figure 3:
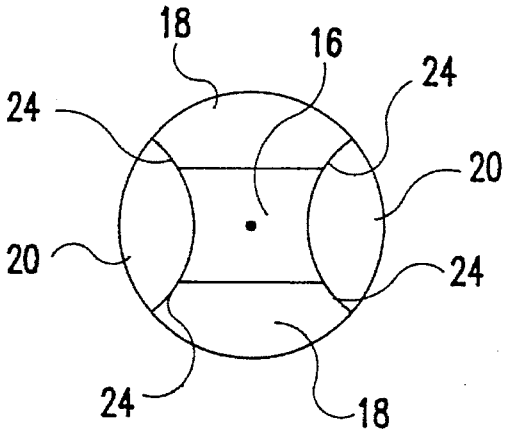
FIG. 3 is an end view of the arrowhead point of FIG. 1 showing the conical forward region with the chisel and wedge regions located about the circumference of the point.

With reference to FIGS. 1–3, the point design comprises a conical forward region 16, a pair of chisel regions 18 on opposing sides of the arrowhead 10, and a pair of wedge regions 20 on opposing sides of the arrowhead 10, wherein the wedge regions 20 are positioned adjacent and between the chisel regions 18 around the circumference of the arrowhead 10. FIGS. 1 and 2 show that it is preferred to have the chisel regions 18 and wedge regions 20 start at the same point aft of the conical forward region 16 and terminate at the same point on the body 22 of the arrowhead 10 (or point base). In addition, FIG. 3 shows that it is preferred that the chisel regions 18 and wedge regions 20 abut or intersect with one another along lines 24. However, it should be understood that the start point and termination point of the chisel regions 18 and wedge regions 20 can vary for different applications, such that, in certain situations the chisel regions 18 will be longer or shorter than the wedge regions 20. In addition, it should be understood that dimensions of the chisel regions 18 and wedge regions 20 about the circumference of the arrowhead 10 can vary such that they do not abut or intersect at lines 24 as shown in FIG. 3. However, it is important that both the chisel regions 18 be on opposite sides of the point, and the wedge regions 20 be on opposite sides of the point, and that the chisel regions 18 alternate with the wedge regions 20 about the circumference of the point.

The chief difference between the conical forward region 16 and the chisel regions 18 and wedge regions 20, is that the conical forward region is circular about its circumference, while the chisel regions 18 and wedge regions 20 are planar in character. The conical forward region 16 serves the purpose of directing the arrowhead 10 into a game animal and, if required, starting the arrowhead 10 through difficult to penetrate materials such as bone. The conical forward region 16 may provide flight stability for the arrowhead 10 as it flies through the air prior to impact with an animal in that it directs the air past the chisel regions 18 and wedge regions 20 without having the arrowhead 10 encounter turbulence at those regions. Preferably, the conical forward region is 1/10 to ½ the size of the chisel regions 18 and/or wedge regions 20 and is on the order of 0.05–0.5 inches in length. Because the conical forward region 16 is the first to encounter bone, or other dense matter, it should be sharp. Preferably, the total angle of the conical region will be 5° to 35°.

The "total angle" is measured as the angle from one side of the conical forward region 16 to the other. A half angle would be a measurement of one side of the conical forward region 16 to the longitudinal axis passing through the point of the arrowhead 10. This terminology will be used throughout the rest of the specification.

The chisel regions 18 and wedge regions 20 are responsible for separating the bone, or other dense matter, to allow the arrowhead 10 to more easily traverse therethrough. This will allow the arrowhead 10 to more easily pass through a game animal to cause maximum tissue damage, hemorrhage, and bleed-out.

An important feature of this invention is the "wedging-action" which is provided by the chisel region 18 wedge region 20 combination.

The chisel regions 18 are akin to the sides of a wedge and are angled to allow the arrowhead 10 to traverse more easily to a deeper point in the bone or dense matter. The total angle of the chisel regions 18 is preferably similar to, and slightly smaller than that of the conical forward region 16 (e.g., on the order of 5°–35°). For example, if the conical forward region 16 total angle is 30°, the total angle provided by the chisel regions is 27°–29°.

The wedge regions 20 are each comprised of two distinct angular regions. As is best shown in FIG. 2, the first angular region 26 is positioned aft of the conical forward region 16, and the second angular region 28 is positioned aft of the first angular region 26. The important feature is that the first angular region 26 has a smaller total angle than that of the second angular region 28. Preferably, the first angular region has a total angle ranging between 0°–30°, and the second angular region has a total angle ranging between 10°–60°, and, most preferably, the first angular region total angle is 0°–10° and the second angular region total angle is 30°–60°. The first angular region 26 allows the arrowhead 10 to slip more easily into the bone, and the second angular region 28 opens the bone up (e.g., wedges the bone apart) so that the arrowhead can pass through the bone more easily.

While FIG. 1 depicts the point of this invention as being integral with a cylindrical arrowhead 10, it should be understood that the point could be separable and selectively attachable to an arrowhead or arrow shaft of interest.

While the invention has been described in terms of its preferred embodiments, those skilled in the art will recognize that the invention can be practiced with modification within the spirit and scope of the appended claims.

I claim:

1. A point for an arrowhead, comprising:

a body having a first and a second end, said second end for penetrating a game animal;

a conical region positioned at said second end of said body, said conical region having a first end which terminates at a first axial location on said body, and a second end which terminates in a conical point at said second end of said body;

first and second chisel regions positioned on opposite sides of said body, said first and second chisel regions each beginning on said body at said first axial location on said body and terminating at a second axial location on said body; and first and second wedge regions positioned on opposite sides of said body and radially between said first and second chisel regions, said first and second wedge regions each being comprised of first and second angular regions wherein said first angular region begins on said body at said first axial location on said body and terminates at a third axial location on said body, and said second angular region begins on said body at said third axial location on said body and terminates at a fourth axial location on said body, and wherein said first angular region forms a first total angle with respect to a longitudinal axis of said body and said second angular region forms a second total angle with respect to said longitudinal axis of said body and said first total angle is smaller than said second total angle.

2. The point of claim I wherein said conical region has a third total angle of 5°–35°.

3. The point of claim 1 wherein said conical region has an axial dimension of 0.05–0.5 inches.

4. The point of claim 1 wherein said first total angle ranges between 0°–30°.

5. The point of claim 1 wherein said second total angle ranges between 10°–60°.

6. The point of claim 1 wherein said first total angle ranges between 0°–10° and said second total angle ranges between 30°–60°.

7. The point of claim 1 wherein said fourth axial location on said body is approximately the same as said second axial location.

8. The point of claim 1 wherein said fourth axial location on said body is relatively closer to said first end of said body than said second axial location.

9. The point of claim 1 wherein said second axial location on said body is relatively closer to said first end of said body than said fourth axial location.

10. The point of claim 1 wherein said first and second chisel regions form a fourth total angle with respect to said longitudinal axis of said body which ranges between 5° and 35°.

* * * * *